US006877981B1

(12) United States Patent
Kim

(10) Patent No.: US 6,877,981 B1
(45) Date of Patent: Apr. 12, 2005

(54) PORTABLE GAS COOKING RANGE

(76) Inventor: Chung-Il Kim, 848-17, Chooan-dong, Nam-ku, Inchon-shi 402-845 (KR)

( * ) Notice: Subject to any disclaimer, the term of this patent is extended or adjusted under 35 U.S.C. 154(b) by 0 days.

(21) Appl. No.: 10/148,500

(22) PCT Filed: Nov. 21, 2000

(86) PCT No.: PCT/GB00/04436

§ 371 (c)(1),
(2), (4) Date: Sep. 5, 2002

(87) PCT Pub. No.: WO01/38797

PCT Pub. Date: May 31, 2001

(30) Foreign Application Priority Data

Nov. 24, 1999 (KR) ..... 1999-25887

(51) Int. Cl.[7] ..... F23D 11/36
(52) U.S. Cl. ..... 431/153; 126/42; 126/39 G
(58) Field of Search ..... 431/153; 126/42, 126/39 G, 38, 351.1

(56) References Cited

U.S. PATENT DOCUMENTS 4,662,349 A * 5/1987 McKenzie et al. ..... 126/41 R
5,375,585 A * 12/1994 Home ..... 126/39 E
5,975,884 A 11/1999 Dugger
6,074,201 A * 6/2000 Muhle ..... 431/354
6,192,913 B1 * 2/2001 Willey et al. ..... 137/66
6,318,357 B1 * 11/2001 Muhle et al. ..... 126/39 R
6,425,389 B1 * 7/2002 Muhle ..... 126/39 R

FOREIGN PATENT DOCUMENTS

| | | |
|---|---|---|
| DE | 298 00 860 A1 | 4/1998 |
| FR | 2 377 007 | 8/1978 |
| WO | WO 98/09114 | 3/1998 |

* cited by examiner

*Primary Examiner*—Alfred Basichas
(74) *Attorney, Agent, or Firm*—Kirschstein, et al.

(57) ABSTRACT

A portable gas cooking range has a burner, a piezoelectric igniter therefor, a gas canister for supplying gas to the burner, an adjustable gas regulator for varying the flow of gas to the burner, and a flame failure safety device having a theremocouple located in close proximity to the burner and which is operably connected to a gas valve in the gas regulator. The gas valve is capable of opening and closing according to the electromotive force produced in use by the thermocouple, so as to shut off the flow of gas through the valve if the ignited burner is accidentally or inadvertently extinguished and, hence, prevent escape of gas from the burner when in a non-ignited condition.

1 Claim, 3 Drawing Sheets

PORTABLE GAS COOKING RANGE

This invention relates to portable gas cooking ranges and is concerned with a flame failure safety device for incorporation in a portable gas range.

Portable gas ranges are used for cooking mainly in outdoor locations, for example for picnics or barbeques, and in mobile locations, such as in pleasure and fishing boats and caravans and motorhomes (campervans). One type of outdoor stove is described in WO-A-9809114 as having a piezoelectric lighter which can be manually actuated to produce a spark which will ignite fuel flowing into an ignition space formed in the burner. U.S. Pat. No. 5,975,884 discloses a gas operated device such as a cooking device having a burner associated with a hand-lit pilot light used for igniting gas fed to the burner and a separate temperature regulating system comprising a thermocouple and a temperature control.

However, because of the relatively small size of such portable gas ranges problems can arise during their use, causing the ignited burner to be extinguished, for example by overflowing food or windy conditions. Such sudden accidental extinguishing of the ignited burner normally causes gas to escape, and if the user attempts to reignite the burner, an accidental fire or explosion can occur.

It is therefore an object of the invention to provide a portable gas range which will obviate the danger accompanying the use of known portable gas ranges.

According to the invention, there is provided a portable gas cooking range capable of use in an outdoor location, the range having a burner and a piezoelectric igniter therefor, means for supplying gas from a gas canister to said burner and an adjustable gas regulator for varying the flow of gas to the burner, wherein the gas regulator and the burner are connected by a substantially horizontal feed pipe through which gas can flow from the gas canister to the burner, the piezoelectric igniter is positioned adjacent to the burner and is caused to ignite gas flowing to the burner via said feed pipe by manual operation of a flame regulating knob operably connected to the gas regulator to which the piezoelectric igniter is also operably connected, and a flame failure safety device incorporating a thermocouple is located in close proximity to the burner and is operably connected to a gas valve in the gas regulator, the arrangement being such that manual operation of the flame regulating knob can cause simultaneous operation of the gas valve and piezoelectric igniter and of the flame failure safety device thermocouple.

For a better understanding of the invention and to show how the same may be carried into effect, reference will now be made, by way of example, to the accompanying drawings in which.

Figure 1:
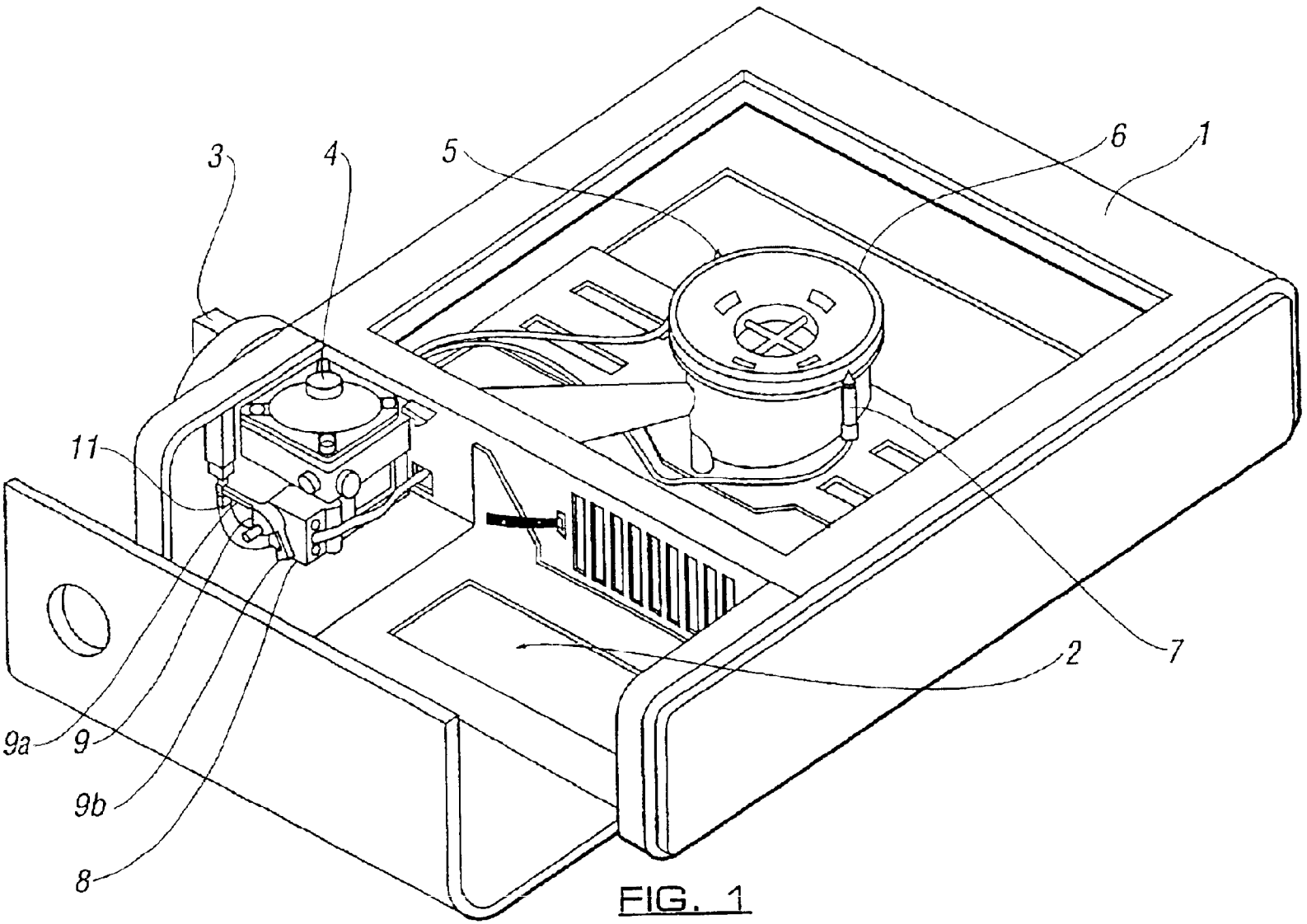
FIG. 1 is an isometric view of one embodiment of a portable gas range according to the invention.

Referring to the drawings, a casing (1) houses an igniter (5), a burner (6), a gas canister holder (2) and a gas regulator (4) which is connected to a flame regulating knob (3) on the exterior of the casing. The gas regulator (4) incorporates a magnetic gas valve (8) having a press button (10) and is connected to a thermocouple (7) situated beside the burner (6). On the upper part of the gas valve (8) there is a revolvable lever (9) comprising a safety device (9*a*) and a main body (9*b*). The safety device (9*a*) is operated up and down by a projecting part (11) of the flame regulating knob (3). The main body (9*b*) includes the press button (10) at the lower part which is to be pushed by an inclining part (12) for setting or releasing.

Figure 2A:
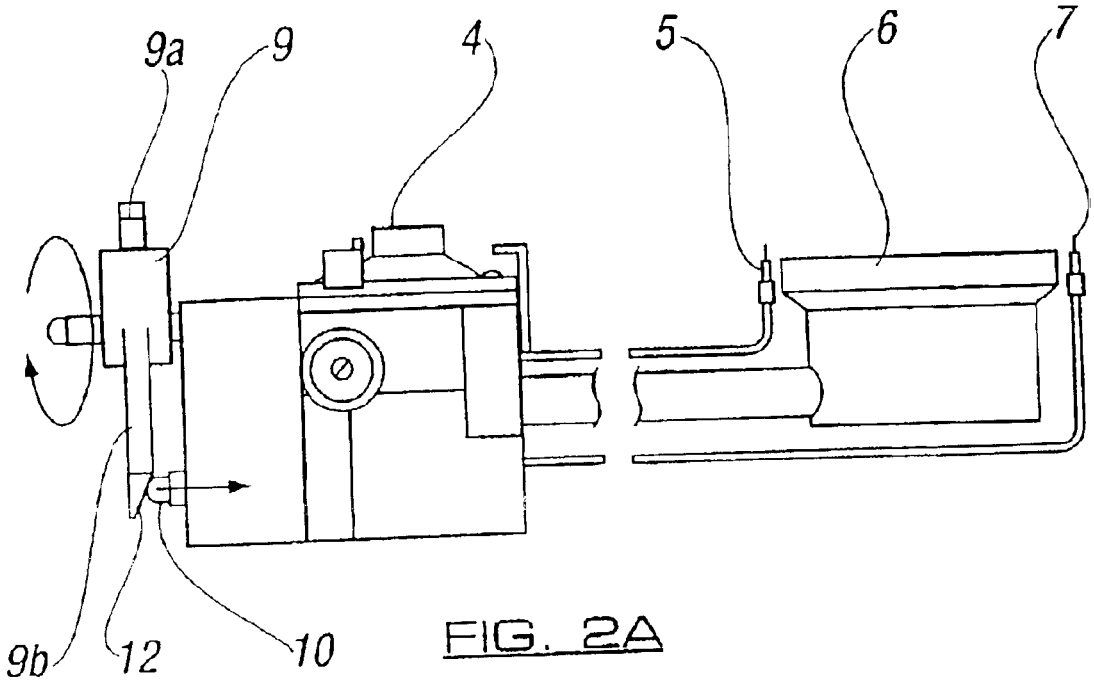
FIG. 2A is a partial front view of the portable gas range of FIG. 1 in a turn on position.
Figure 2B:
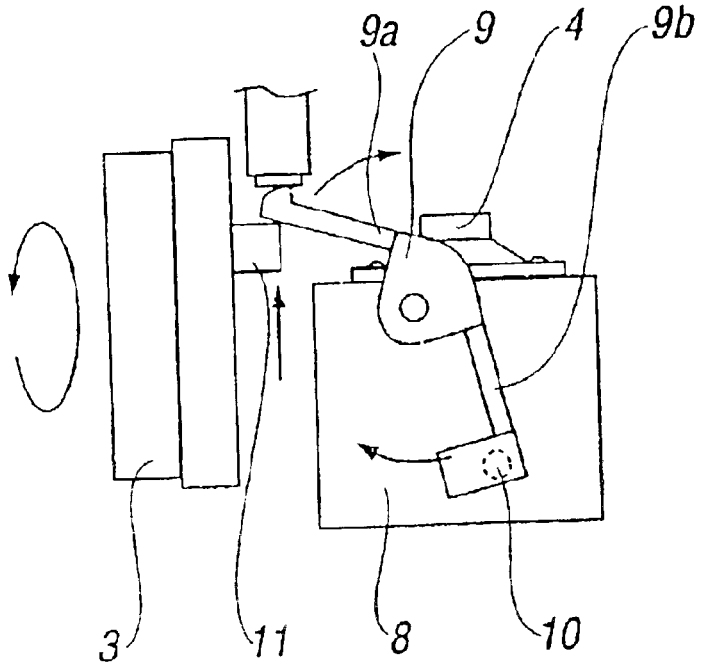
FIG. 2B is a partial side view of the portable gas range of FIG. 2A.

In order to use the gas range for cooking, as shown in FIGS. 2A/2B, the flame regulating knob (3) is to be turned on. Then the revolvable lever (9) on the upper part of gas valve (8) is to be pushed upwards to turn on the safety device (9*a*). The inclining part (12) in the main body (9*b*) of revolvable lever (9) pushes the press button (10) of gas valve (8) to open the gas valve (8) and to supply gas to the burner (6). At the same time, ignition is effected by spark by igniter (5) and heat is transferred to the thermocouple (7) placed at one side of burner (6) after a lapse of time. Heat from the burner (6) causes the thermocouple (7) to generate an electromotive force by thermosensor between two dissimilar metallic conductors having different resistivity. Even after the press button (10) is released and is projected back, the electromotive force can hold open the gas valve (8) and the gas is continuously supplied to the burner (6).

Figure 3A:
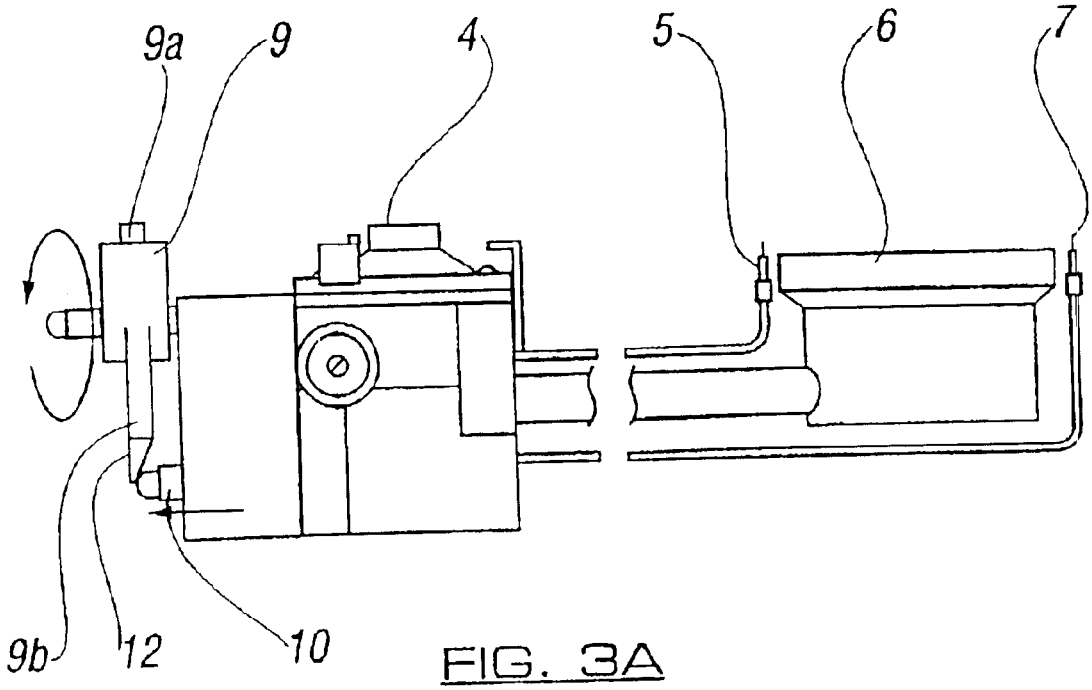
FIG. 3A is a partial front view of the portable gas range in a turn off position.
Figure 3B:
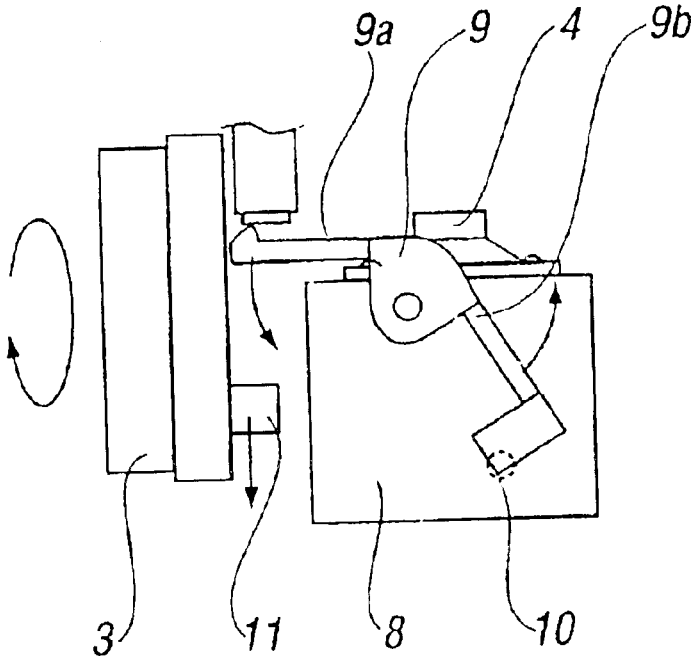
FIG. 3B is a partial side view of the portable gas range of FIG. 3A.

Even if the flame at the burner (6) is extinguished due to overflowing of food or by instant breakdown while using the gas range, as shown in FIGS. 3A/3B the thermocouple (7) senses that there is no more heat and then it operates the gas valve (B) by electromotive force produced by the thermocouple (7). The press button (10) then returns back to a gas shut-off position and the gas supply is automatically shut-off.

For initial ignition the press button (10) of gas valve (8) is pushed by flame regulating knob (3) and revolvable lever (9) together. After ignition by igniter (5), when the gas is supplied to the burner (6), the electromotive force produced by the heat sensed by thermocouple (7) keeps the gas supply continuously flowing to the burner (6).

If the igniter fails or when the flames goes out, the thermocouple (7) senses it and cuts off the gas supply. In this matter the automatic prevention of gas leakage ensures the user's convenience and safety.

In addition, this embodiment of the invention which includes the magnetic gas valve (8) operated by revolvable lever 9) and thermocouple (7) is of the same size as the existing small-sized portable gas ranges, which solves the current problem that the existing portable gas ranges cannot be equipped with a safety device due to their limiting small size.

What is claimed is:

1. A portable gas cooking range, comprising:

a) a burner;

b) a piezoelectric igniter positioned adjacent to the burner;

c) a holder for a gas canister, and mean for supplying a gas from the holder to the burner;

d) an adjustable gas regulator for varying a flow of the gas to the burner, the gas regulator incorporating a magnetic gas valve having a press button for opening the gas valve, and a revolvable lever having one arm for operating the press button, and another arm for operating a flame failure safety device, said device incorporating a thermocouple located in close proximity to the burner and operably connected to the gas valve in the gas regulator;

e) a substantially horizontal feed pipe for connecting the gas regulator to the burner; and f) a manually operable flame regulating knob having a projecting part for causing rotation of the revolvable lever upon manual operation of the knob with consequential simultaneous operation of the safety device and of the press button for opening the gas valve and causing the operation of the piezoelectric igniter to ignite the gas flowing through the feed pipe to the burner;

whereby the thermocouple actuates the magnetic gas valve so as to cut off the gas flow to the burner if the thermocouple senses a sudden reduction in temperature at the burner as a consequence of the flame going out.

* * * * *